US011877649B1

(12) United States Patent
Addington et al.

(10) Patent No.: US 11,877,649 B1
(45) Date of Patent: Jan. 23, 2024

(54) DESKS WITH MULTIPLE ADJUSTABLE TOP PANELS

(71) Applicant: BRAND VILLAGES, LLC, Fayetteville, AR (US)

(72) Inventors: Steven Andrew Addington, St. Paul, MN (US); Andrew Phillip Addington, Minneapolis, MN (US); Thomas Gordon Addington, Fayetteville, AR (US)

(73) Assignee: BRAND VILLAGES, LLC, Fayetteville, AR (US)

( * ) Notice: Subject to any disclaimer, the term of this patent is extended or adjusted under 35 U.S.C. 154(b) by 0 days.

(21) Appl. No.: 17/871,349

(22) Filed: Jul. 22, 2022

(51) Int. Cl.
*A47B 21/02* (2006.01)
*A47B 9/20* (2006.01)
*A47B 13/08* (2006.01)

(52) U.S. Cl.
CPC ..... *A47B 21/02* (2013.01); *A47B 9/20* (2013.01); *A47B 13/088* (2013.01)

(58) Field of Classification Search
CPC ..... A47B 13/088; A47B 9/20; A47B 21/02
USPC ..... 108/96, 60
See application file for complete search history.

(56) References Cited

U.S. PATENT DOCUMENTS 4,604,955 A 8/1986 Fleischer et al.
5,224,429 A * 7/1993 Borgman ..... A47B 17/033 248/188.4
5,323,695 A * 6/1994 Borgman ..... A47B 9/00 108/147
5,394,809 A * 3/1995 Feldpausch ..... A47B 9/14 108/147.21
5,443,017 A * 8/1995 Wacker ..... A47B 17/02 108/5
5,531,168 A * 7/1996 Towfigh ..... A47B 17/02 108/108
5,752,449 A * 5/1998 Simon ..... A47B 9/00 108/50.02
6,135,032 A * 10/2000 Ko ..... A47B 9/083 108/147.21
7,357,086 B2 * 4/2008 Petrick ..... A47B 21/00 108/50.02
9,125,486 B2 * 9/2015 Rheault ..... A47B 21/06
9,532,647 B2 * 1/2017 Bedard ..... A47B 83/04
10,039,374 B2 * 8/2018 Abraham ..... A47B 13/10
10,413,063 B2 * 9/2019 Lee ..... A47B 87/002
10,842,258 B2 11/2020 Applegate et al.
(Continued)

*Primary Examiner* — Jose V Chen
(74) *Attorney, Agent, or Firm* — Edlavitch Law PLLC

(57) ABSTRACT

Described herein are apparatuses (such as desks) with adjustable top panels. In some embodiments, an apparatus includes a frame, having a movable component that is configured to move upwards and downwards. The apparatus also includes: a first top panel attached to the movable component and configured to move upwards and downwards with the movable component, and a second top panel attached to the frame and aligned parallel to the first panel, so that the first panel is adjustable to be flush with the second panel or adjustable to a level above the second panel. The apparatus can also include a barrier panel attached to the frame or the first panel, arranged perpendicular to the first and second panels and oriented downward from the first panel at a side of the first panel closest to the second panel.

20 Claims, 8 Drawing Sheets

(56) References Cited

U.S. PATENT DOCUMENTS

| | | | | |
|---|---|---|---|---|
| 2014/0312754 | A1* | 10/2014 | Hecht | A47B 83/045 312/317.3 |
| 2016/0095433 | A1* | 4/2016 | Cho | A47B 83/001 108/50.02 |
| 2016/0345723 | A1* | 12/2016 | Lanphear | A47B 13/088 |
| 2017/0251806 | A1 | 9/2017 | Newman | |
| 2018/0064243 | A1* | 3/2018 | Keller | A47B 13/088 |
| 2018/0295982 | A1* | 10/2018 | Yamamoto | A47B 9/00 |
| 2019/0142155 | A1* | 5/2019 | Lee | A47B 13/06 108/27 |
| 2019/0365089 | A1* | 12/2019 | Lee | A47B 9/16 |
| 2019/0374024 | A1* | 12/2019 | Elliott | A47B 13/088 |
| 2021/0106133 | A1* | 4/2021 | Anderson | H02G 3/0406 |

* cited by examiner

DESKS WITH MULTIPLE ADJUSTABLE TOP PANELS

TECHNICAL FIELD

The present disclosure relates to desks having multiple adjustable top panels and methods thereof.

BACKGROUND

Standing desks have become prolific and are found in many different shapes and sizes. Some of such desks are static and others can be adjusted to conform to different types of tasks or to improve comfort and ergonomics. For example, some variations include a telephone desk, a teacher's desk, or various types of desks for business professionals such as accountants, attorneys, and architects. Some standing desks may only be used while standing while others permit users to sit or stand by adjusting the desk height. The height can be adjusted via an electric motor, hand crank, or the like.

It can be preferred that the height of a standing desk fits the height of its user. However, some standing desks conform to certain changeable settings. Fortunately, other desks have been produced with more flexible settings. But, with that said, there is a lot of room for improvement. Previous solutions include custom-made standing desks or non-custom desks with adjustable top surfaces. Also, for writing or drafting, the angle or slant of the surface may be adjustable in some examples.

Besides increased comfort, an adjustable standing desk (also known as a sit-stand desk) may have many health benefits. For example, a sit-stand desk may be effective at reducing sitting time during a work day as well as improving posture of its users. Sit-stand workstations may also reduce lower back pain amongst workers.

Because of the wide use of sit-stand desks as well as similar types of adjustable furniture (e.g., tables with adjustable top panels), there is always a need to improve upon the technology for adjusting top panels or working surfaces of such furniture.

SUMMARY

Described herein are novel desks having multiple adjustable top panels and methods thereof. In a more general sense, described herein are apparatuses (such as desks, e.g., see desk 100 shown in FIG. 1) with adjustable top panels (e.g., see panels 110 and 112) as well as methods thereof (e.g., see method 1200 shown in FIG. 12).

In some embodiments, an apparatus includes a frame (e.g., see frame 102) that has movable parts that are configured to move upwards and downwards. For example, the frame has a first movable component (e.g., see movable component 104) that is configured to move upwards and downwards. The apparatus also includes: a first top panel (e.g., see back top panel 110) attached to the first movable component (e.g., see movable component 104) and configured to move upwards and downwards with the first movable component, and a second top panel (e.g., see top front panel 112) attached to the frame, in which the frame can further includes a second movable component (e.g., see movable component 106) that is configured to move upwards and downwards with the second top panel and is aligned parallel to the first panel (e.g., see back top panel 110), so that the first panel is adjustable to be flush with the second panel or adjustable to a level above the second panel.

As mentioned, in some embodiments, a part of the frame (e.g., see frame 102) is a moveable component that is configured to move the second top panel (e.g., see top front panel 112) upwards and downwards and move the first top panel (e.g., see back top panel 110) upwards and downwards in tandem. In such examples, the first top panel (e.g., see back top panel 110) is able to move upwards and downwards in tandem with the second top panel (e.g., see top front panel 112) or independent of the second top panel. The apparatus can also include a barrier panel (e.g., see barrier panel 114) attached to the frame (e.g., see frame 102) or the first panel (e.g., see back top panel 110), arranged perpendicular to the first and second panels (e.g., see panels 110 and 112) and oriented downward from the first panel at a side of the first panel closest to the second panel.

In some embodiments, an apparatus includes a frame (e.g., see frame 102), including a movable component (e.g., see movable component 104) that is configured to move upwards and downwards. The apparatus also includes a plurality of top panels (e.g., see panels 110 and 112), which include a first top panel (e.g., see back top panel 110) attached to the movable component and configured to move upwards and downwards with the movable component. The panels also include a second top panel (e.g., see top front panel 112) attached to the frame and aligned parallel to the first top panel, so that the first top panel is adjustable to be flush with the second top panel (e.g., see FIG. 2) or adjustable to a level above the second top panel (e.g., see FIG. 1). The apparatus also includes a barrier panel (e.g., see barrier panel 114) attached to the frame or the first top panel and arranged perpendicular to the first and second top panels and oriented downward from the first top panel at a side of the first top panel closest to the second top panel, so that the barrier panel provides a wall interfacing the first and second top panels when the first top panel is adjustable to a level above the second top panel.

In some of such examples, the frame (e.g., see frame 102) includes a second movable component (e.g., see movable component 106) that is configured to move upwards and downwards. And, the second top panel (e.g., see top front panel 112) is attached to the second movable component and configured to move upwards and downwards with the second movable component.

Also, in some embodiments, the movable component is a first movable component and the first movable component is configured to move upwards and downwards via a first telescoping mechanism including the first movable component and a first fixed part. In such examples, the first movable component and the first fixed part are components of a first leg of the frame. And, the second movable component is configured to move upwards and downwards via a telescoping mechanism including the second movable component and a second fixed part. And, the second movable component and the second fixed part are components of a second leg of the frame.

Further, in some embodiments, respective heights of the first top panel and the second top panel are adjustable independently of each other. And, in some of such examples, the respective heights of the first top panel and the second top panel are further adjustable in tandem.

Also, in some embodiments, the first movable component is a part of a first leg (e.g., see back leg 105) of the frame that is oriented downward from the first top panel. In such examples, the second movable component is a part of a second leg (e.g., see front leg 107) of the frame that is oriented downward from the second top panel. And, the frame further includes an interface configured to attach the first leg of the frame to the second movable component of the frame (e.g., see bridge 108), so that the first leg moves upwards and downwards with the second movable component.

In some embodiments, the apparatus includes a desk (e.g., see desk 100) and the first top panel is at a back portion of the desk and the second top panel is at a front portion of the desk. In some of such examples, the desk includes shelving positioned above the barrier panel (e.g., see FIG. 10). In some examples with shelving, the top panels are movable to be flush with each other. In some other examples, such as the example embodiment shown in FIG. 10, the panels are movable but cannot be positioned flush with each other. This is a safety feature to prevent pinching or squeezing from the opening of the shelving accidentally closing on property or a user. Either way, in such examples and others, the shelving can move upwards and downwards with the barrier panel and the back top panel.

In some embodiments, the first movable component is configured to move upwards or downwards according to movement of at least one first actuator, and conversion of electrical energy into motion of the at least one first actuator is according to a first user input. In some of such embodiments, the second movable component is configured to move upwards or downwards according to movement of at least one second actuator, and conversion of electrical energy into motion of the at least one second actuator is according to a second user input.

In some embodiments, the first movable component is configured to move upwards or downwards according to movement of at least one first motor (e.g., see motor 300 shown in FIG. 3). And, the at least one first actuator is a part of the at least one first motor, and conversion of electrical energy into motion of the at least one first motor is according to the first user input. In some of such examples, the second movable component is configured to move upwards or downwards according to movement of at least one second motor (e.g., see motor 302). Also, the at least one second actuator is a part of the at least one second motor, and conversion of electrical energy into motion of the at least one second motor is according to the second user input.

In some embodiments, the first user input or the second user input (or any other user input described herein) is part of a computing device or a circuit that is attached to the apparatus. In some other embodiments, the first user input or the second user input (or any other user input described herein) is part of an electronics device separate from the apparatus. For example, the electronics device can include smartphone, smart watch, or personal computer.

In some embodiments, a method includes a movable component (e.g., see movable component 104) of a frame (e.g., see frame 102) moving upwards or downwards (e.g., see step 1202). Also, the method includes a first top panel (e.g., see top front panel 110) attached to the movable component moving upwards and downwards with the movable component (e.g., see step 1204). A second top panel (e.g., see top front panel 112) is attached to the frame and aligned parallel to the first top panel, so that the first top panel is adjustable to be flush with the second top panel (e.g., see FIG. 2) or adjustable to a level above the second top panel (e.g., see FIG. 1). The method also includes barrier panel (e.g., see barrier panel 114) providing a wall interfacing the first and second top panels when the first top panel is adjustable to a level above the second top panel (e.g., see step 1206). The barrier panel is attached to the frame or the first top panel and arranged perpendicular to the first and second top panels and oriented downward from the first top panel at a side of the first top panel closest to the second top panel. In some of such examples of the method, it further includes a second movable component (e.g., see movable component 106) of the frame moving upwards or downwards (e.g., see step 1208). The method also includes the second top panel is attached to the second movable component moving upwards and downwards with the second movable component (e.g., see step 1210).

In some embodiments, the movable component is a first movable component and the first movable component is a part of a first leg of the frame (e.g., see leg 105) that is oriented downward from the first top panel. And, the second movable component is a part of a second leg of the frame (e.g., see leg 107) that is oriented downward from the second top panel, and the frame further includes an interface configured to attach the first leg of the frame to the second movable component of the frame. In such examples, the method can further include the first leg moving upwards and downwards with the second movable component (e.g., see step 1212). Also, in some of such examples, the frame is part of a desk (e.g., see desk 100) and the first top panel is at a back portion of the desk and the second top panel is at a front portion of the desk. Such as shown in FIG. 1, some embodiments are a desk including a frame including a movable component that is configured to move upwards and downwards. The desk also includes a plurality of top panels, including: a back top panel attached to the movable component and configured to move upwards and downwards with the movable component; and a top front panel attached to the frame and aligned parallel to the back top panel, so that the back top panel is adjustable to be flush with the top front panel (such as shown in FIG. 2) or adjustable to a level above the top front panel (such as shown in FIG. 1). The desk also includes a barrier panel attached to the frame or the back top panel and arranged perpendicular to the back and top front panels and oriented downward from the back top panel at a side of the back top panel closest to the top front panel, so that the barrier panel provides a wall interfacing the back and top front panels when the back top panel is adjustable to a level above the top front panel.

In some of such examples, the frame of the desk includes a front movable component that is configured to move upwards and downwards, and the top front panel attached to the front movable component and configured to move upwards and downwards with the front movable component. Also, in some examples, the movable component is a back movable component that is a part of a back leg of the frame that is oriented downward from the back top panel. Also, in some instances, the front movable component is a part of a front leg of the frame that is oriented downward from the top front panel. And, in some embodiments, the desk further includes an interface configured to attach the back leg of the frame to the front movable component of the frame, so that the back leg moves upwards and downwards with the front movable component. The aforementioned are shown specifically in FIG. 1.

Although the great majority of examples illustrated herein include desks or more, specifically, sit-stand desks, it is to be understood that some embodiments include or are for other types of furniture or apparatuses with one or more adjustable top panels or working surfaces.

These and other important aspects of the invention are described more fully in the detailed description below. The invention is not limited to the particular assemblies, apparatuses, methods and systems described herein. Other embodiments can be used and changes to the described embodiments can be made without departing from the scope of the claims that follow the detailed description.

BRIEF DESCRIPTION OF THE DRAWINGS

The present disclosure will be understood more fully from the detailed description given below and from the accompanying drawings of various embodiments of the disclosure.

DETAILED DESCRIPTION OF EXAMPLE EMBODIMENTS

Figure 1:
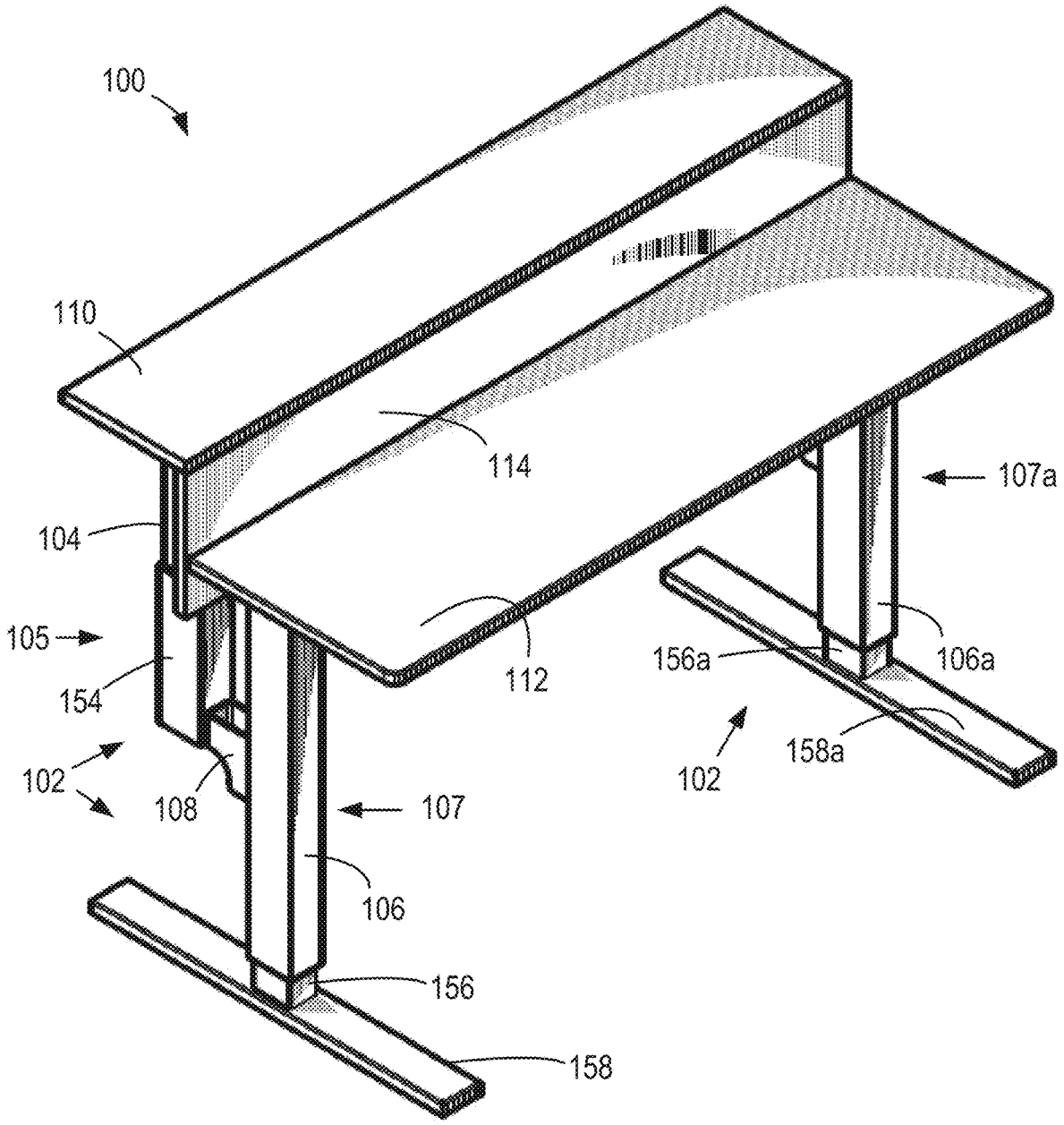
FIGS. 1 and 2 illustrate front perspective views of a desk including multiple movable panels, in accordance with some embodiments of the present disclosure.

Details of example embodiments of the invention are described in the following detailed description with reference to the drawings. Although the detailed description provides reference to example embodiments, it is to be understood that the invention disclosed herein is not limited to such example embodiments. But to the contrary, the invention disclosed herein includes numerous alternatives, modifications and equivalents as will become apparent from consideration of the following detailed description and other parts of this disclosure.

Described herein are novel desks having multiple adjustable top panels and methods thereof. In a more general sense, described herein are apparatuses (such as desks, e.g., see desk 100 and some parts of the desk 100 shown in FIGS. 1 to 9 or see desk 1000 and parts of the desk 1000 shown in FIGS. 10 and 11) with adjustable top panels (e.g., see panels 110 and 112 as well as panels 1010 and 1012) as well as methods thereof (e.g., see method 1200 shown in FIG. 12).

In improving desks having multiple adjustable top panels, the technologies described herein overcome many technical problems with such products. Also, the techniques and designs disclosed herein provide specific technical solutions to at least overcome the technical problems mentioned in the background section or other parts of the application as well as other technical problems not described herein but recognized by those skilled in the art. For instance, desks described herein can allow users to work on computers, participate in video conferencing calls, and perform general work tasks from a range of comfortable standing or sitting positions. Such desks may include a rear platform designed to hold computer monitors and webcams, as well as a desk surface used for activities related to a computer, keyboard, mouse, and writing. In some examples, the rear platform and desk surface are each height adjustable and move up and down in tandem with each other, and can also be adjusted independently of each other. Also, in some examples, the rear platform and desk surface can be positioned flat as a one combined work surface, which is able to move up and down as an integrated work surface. Furthermore, a finger safety barrier or force-limiting sensor can prevent injury to the user or objects where the rear platform and desk surface meet.

At the very least, the technologies described herein provide the following solutions to technical problems. The technologies provide a system to raise and lower the rear platform and desk surface of a sit-stand desk in a way that allows: both surfaces to be raised or lowered together, each surface to adjust independent of each other, and both surfaces to be combined and positioned flat as a combined work surface. Also, the techniques provide a design with a divided-top height-adjustable desk with two legs extending to desk feet instead of four legs extending to desk feet. Further, as mentioned, in some embodiments, the technical improvements can prevent injury to fingers and hands with a finger safety barrier as well as limit objects from falling off the desk surface with such a barrier. Moreover, the technologies described herein offer significant weight and material savings over previous designs that use two pairs of motorized legs that extend to the floor completely. In addition, the legs can move together when adjusting the desk between the sitting and standing position.

In some embodiments, an operator uses a control box with buttons to move the entire desk area up and down depending on if they prefer to be in a standing for sitting position. Additional buttons on the controls box, or on a separate control box move the rear platform up and down to adjust monitor height. The user can move the rear platform to position the monitor for different tasks or to move the webcam into a position for video meetings. The user may also lower the rear platform to create a larger level work surface.

In some embodiments, the mechanism to move the rear platform up and down could take several forms. It could be motorized telescoping legs, electric actuators, rack and pinion gear, or a scissor lift mechanism. The rear platform can include storage compartments, drawers, or other organizing features. The desk surface can also include storage compartments, drawers, or other organizing features.

In some embodiments, an apparatus includes a frame (e.g., see frame 102 or 1002) that has movable parts that are configured to move upwards and downwards. For example, the frame has a first movable component (e.g., see movable component 104 or 1004) that is configured to move upwards and downwards. The apparatus also includes: a first top panel (e.g., see back top panel 110 or 1010) attached to the first movable component (e.g., see movable component 104 or 1004) and configured to move upwards and downwards with the first movable component, and a second top panel (e.g., see top front panel 112 or 1012) attached to the frame, in which the frame can further include a second movable component (e.g., see movable component 106 or 1006) that is configured to move upwards and downwards with the second top panel and is aligned parallel to the first panel (e.g., see back top panel 110 or 1010), so that the first panel is adjustable to be flush with the second panel or adjustable to a level above the second panel.

As mentioned, in some embodiments, a part of the frame (e.g., see frame 102 or 1002) is a moveable component that is configured to move the second top panel (e.g., see top front panel 112 or 1012) upwards and downwards and move the first top panel (e.g., see back top panel 110 or 1010) upwards and downwards in tandem. In such examples, the first top panel (e.g., see back top panel 110 or 1010) is able to move upwards and downwards in tandem with the second top panel (e.g., see top front panel 112 or 1012) or independent of the second top panel. The apparatus can also include a barrier panel (e.g., see barrier panel 114 or 1014) attached to the frame (e.g., see frame 102 or 1002) or the first panel (e.g., see back top panel 110 or 1010), arranged perpendicular to the first and second panels (e.g., see panels 110 or 1010 and 112 or 1012) and oriented downward from the first panel at a side of the first panel closest to the second panel.

Some embodiments include at least one moveable top panel. For example, in some embodiments, only a top front panel is moveable. In some other examples, only a back top panel is moveable. In some embodiments, both front and back top panels are moveable, such as shown the top panels shown in FIGS. 1 to 11. Not depicted, some embodiments include more than two top panels and in such embodiments one or more of such panels are movable or adjustable.

Figure 2:
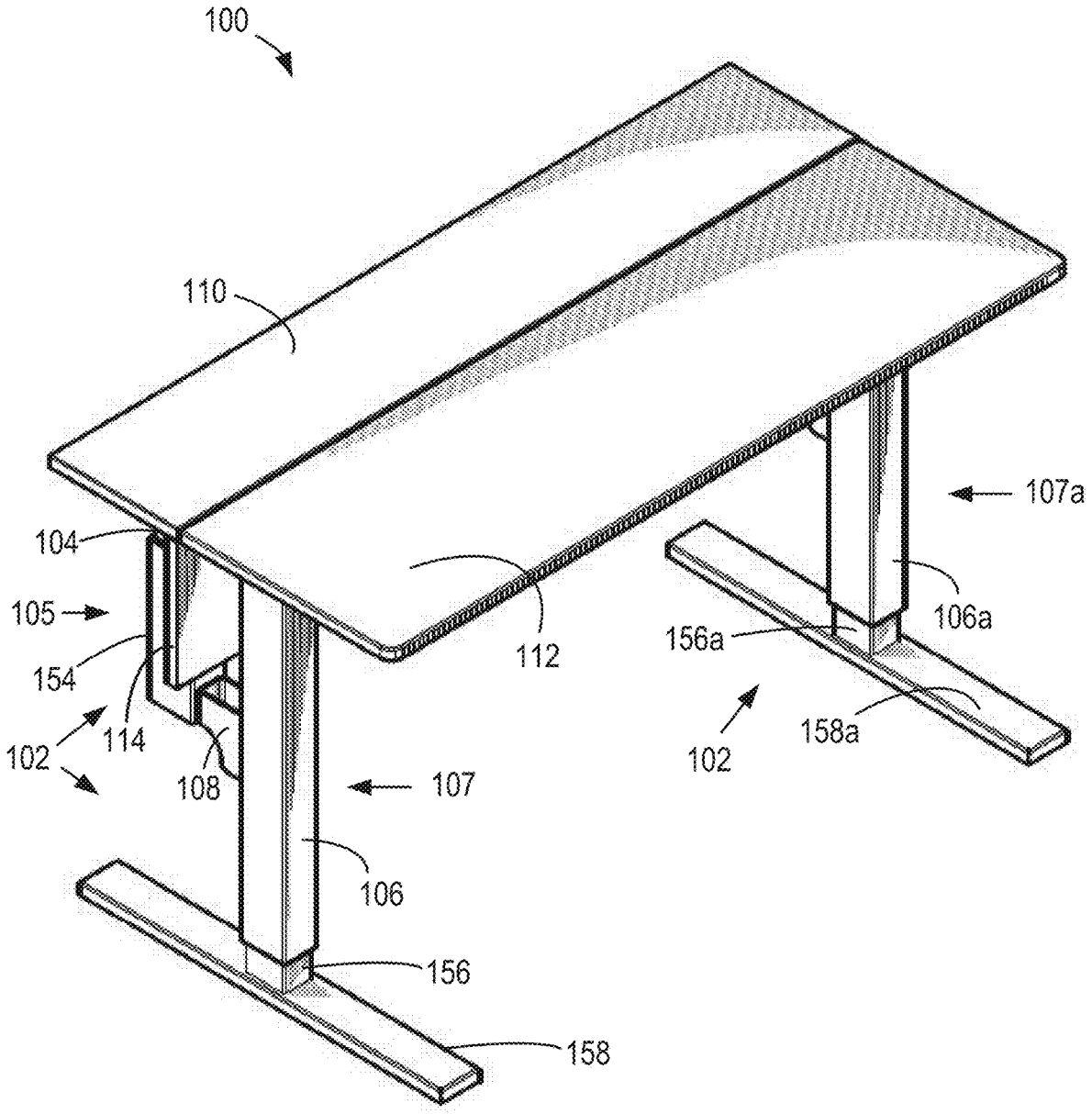

Specifically, FIGS. 1 and 2 illustrate front perspective views of a desk 100 including multiple movable panels. The multiple movable panels are attached to a frame 102 that includes a movable component 104 (which is a part of back leg 105). The frame 102 also includes a movable component 106 (which is a part of front leg 107). The frame 102 also includes a bridge 108 that connects the back leg 105 and the front leg 107. As shown, the front leg 107 extends downward to a foot 158 of the desk 100. The back leg 105 extends downward to the bridge 108. Because of the arrangement of the legs, a foot is only used for each front leg of desk (e.g., see feet 158 and 158*a* attached to the bottom of legs 107 and 107*a*). This simplifies the structure of the desk 100 and makes it more economical to manufacture. The back leg 105 extends from a back top panel 110 of the desk 100. And, the front leg 107 extends from a top front panel 112 of the desk 100. The multiple panels of the desk 100 include back top panel 110, top front panel 112, and barrier panel 114 that interfaces the back and top front panels. As shown, the desk 100 also includes respective legs opposing the front and back legs. These opposing legs include front leg 107*a* and back leg 105*a* (shown in FIG. 5). Thus, the desk 100 includes four legs in which the two front legs extend downward to feet of the desk (e.g., see feet 158 and 158*a*) from the top front panel 112 and the two back legs extend downward to the bridge 108 and its opposing bridge 108*a*, respectively, from the back top panel 110. The legs also include telescoping features, which will be explained in greater detail with reference to FIGS. 6 to 9. Each telescoping feature includes a fix part and a movable part to extend and contract the legs (e.g., see movable component 104, 104*a*, 106, and 106*a* and fixed parts 154, 154*a*, 156, and 156*a*). Referring back to FIGS. 1 and 2, the back legs 105 and 105*a* are shown extended in FIG. 1 (which provides for the back top panel 110 to be positioned above the top front panel 112) and contracted in FIG. 2 (which provides for the front and back top panels to be flush to each other).

Figure 3:
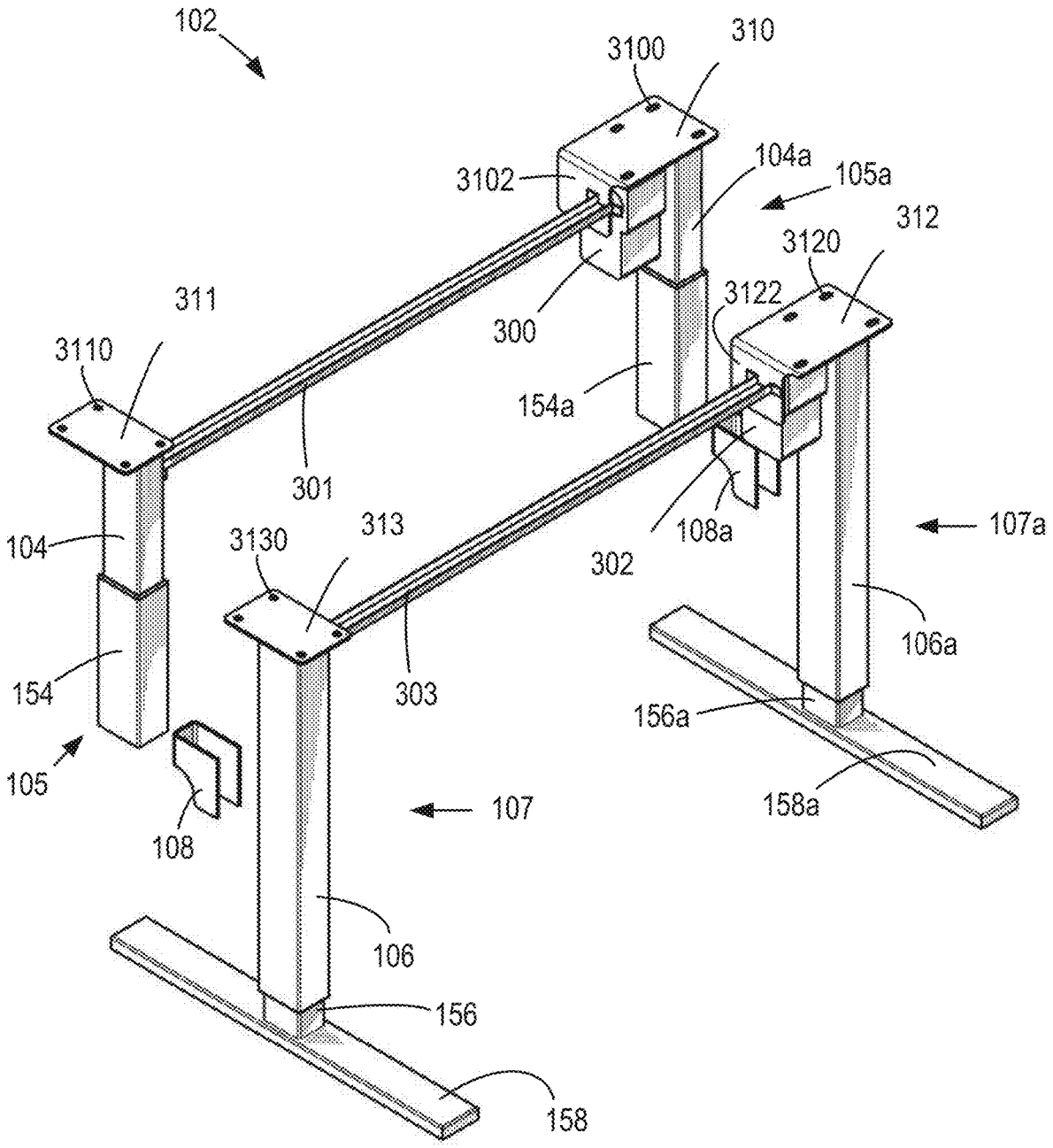
FIG. 3 illustrates a front perspective and exploded view of a frame of the desk illustrated in FIGS. 1 and 2, in accordance with some embodiments of the present disclosure.

FIG. 3 illustrates a front perspective and exploded view of the frame 102 of the desk 100 illustrated in FIGS. 1 and 2. The figure also shows back motor 300 and front motor 302 that drive the upwards and downward movements of the legs of the desk 100. As shown, the motors 300 and 302 each operate with a respective axel (e.g., see axels 301 and 303) so that the back legs of the desk 100 move upwards and towards synchronously with each other and so the front legs of the desk also move upwards and downwards synchronously with each other. The back legs can expand and contract independently of the front legs; however, the back legs cannot expand and contract independent of each other due to the axel 301. And, the front legs cannot expand and contract independent of each other due to the axel 303.

As shown in FIG. 3, the back leg 105*a* differs from back leg 105. Back leg 105*a* has the attachment plate 310, which is configured to interface the back top panel 110 and includes connector parts 3100 that are different from connector parts 3110 of the attachment plate 311 for the leg 105. Similarly, the attachment plate 311 is configured to interface the back top panel 110; however, the plate 311 differs from plate 310 in that it is a simpler plate than plate 310. The attachment plate 310 is more complex in that it is configured to partially encompass a back motor 300 that drives the upwards and downwards movements of the telescoping features of the back legs of the desk 100. As shown, the partial encompassing of the motor 300 includes the plate 310 having a leaflet 3102 transverse to the base of the plate and including an opening for the axel 301 to pass through the plate.

Also, as shown in FIG. 3, the front leg 107*a* differs from front leg 107. Front leg 107*a* has the attachment plate 312, which is configured to interface the top front panel 112 and includes connector parts 3120 that are different from connector parts 3130 of the attachment plate 313 for the leg 107. Similarly, the attachment plate 313 is configured to interface the top front panel 112; however, the plate 313 differs from plate 312 in that it is a simpler plate than plate 312. The attachment plate 312 is more complex in that it is configured to partially encompass a front motor 302 that drives the upwards and downwards movements of the telescoping features of the front legs of the desk 100. As shown, the partial encompassing of the motor 302 includes the plate 312 having a leaflet 3122 transverse to the base of the plate and including an opening for the axel 303 to pass through the plate.

Figure 5:
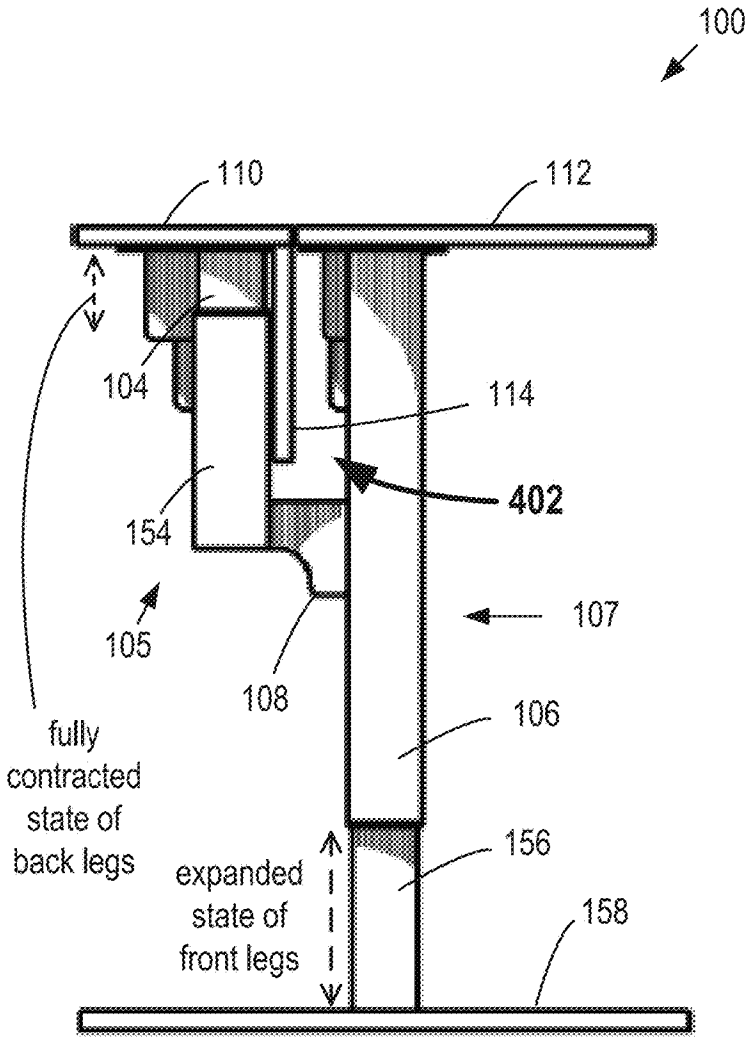
FIGS. 4 and 5 illustrate side perspective views of the desk illustrated in FIGS. 1 and 2, in accordance with some embodiments of the present disclosure.
Figure 4:
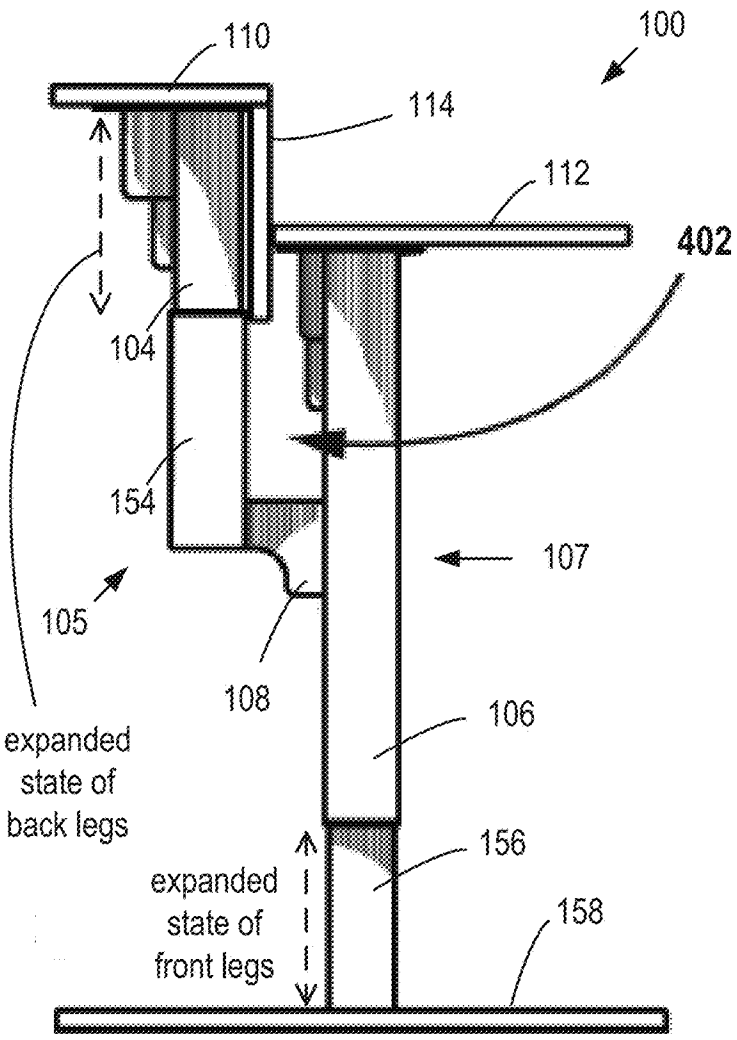

FIGS. 4 and 5 illustrate side perspective views of the desk 100 illustrated in FIGS. 1 and 2, and specifically the figures show expanded and contracted states of the back leg 105 (depicted) and back leg 105*a* (not depicted but inferred from at least the description and illustration of FIG. 3). In FIG. 4, the back leg 105 is shown expanded by the extension of the movable component 104 of the leg out of the fixed part 154 of the leg. In other words, the expanded state of the telescoping feature of the back leg 105 is shown. In the expanded state of the back legs of the desk 100, the back top panel 110 is positioned above the top front panel 112 and the barrier panel 114 is exposed and perpendicularly interfaces the top front and back panels.

In FIG. 5, the back leg 105 is shown contracted by the extension of the movable component 104 of the leg into of the fixed part 154 of the leg. In other words, the contracted state of the telescoping feature of the back leg 105 is shown. In the fully contracted state of the back legs of the desk 100, the back top panel 110 is positioned to be flush with or at the same vertical level of the top front panel 112 and the barrier panel 114 is hidden underneath the front and back panels. As shown, the barrier panel remains perpendicular to the top front and back panels, but does not interface the panels in the fully contracted state.

From the side views of the desk 100 shown in FIGS. 4 and 5, a space 402 becomes apparent and it is apparent that the barrier panel 114 is beneficial in that in prevents items or fluids misplaced or spilled on the front panel to fall into the space 402. Also, barrier panel 114 is beneficial in that it prevents a hand or finger of a user from entering the space 402 and being injured from the movement of the back legs (or in some circumstances from the movement of the front legs). In other words, the barrier panel 114 prevents pinching or squeezing a hand or finger of the user from the coming together of the front and back panels 110 and 112. Also, the panel 114 can prevent other types of objects from being damaged or jammed by the coming together of the front and back panels 110 and 112.

Figure 6:
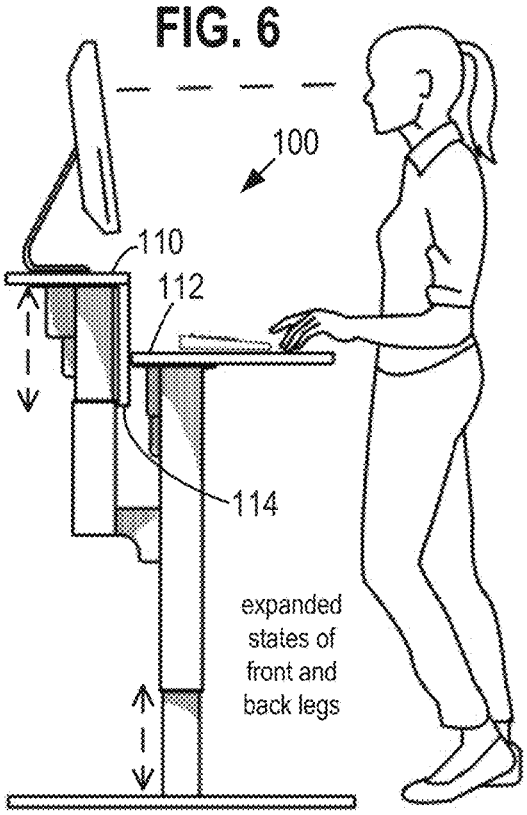
FIGS. 6, 7, 8 and 9 illustrate side perspective views of the desk illustrated in FIGS. 1 and 2 with a person using the desk, in accordance with some embodiments of the present disclosure.
Figure 7:
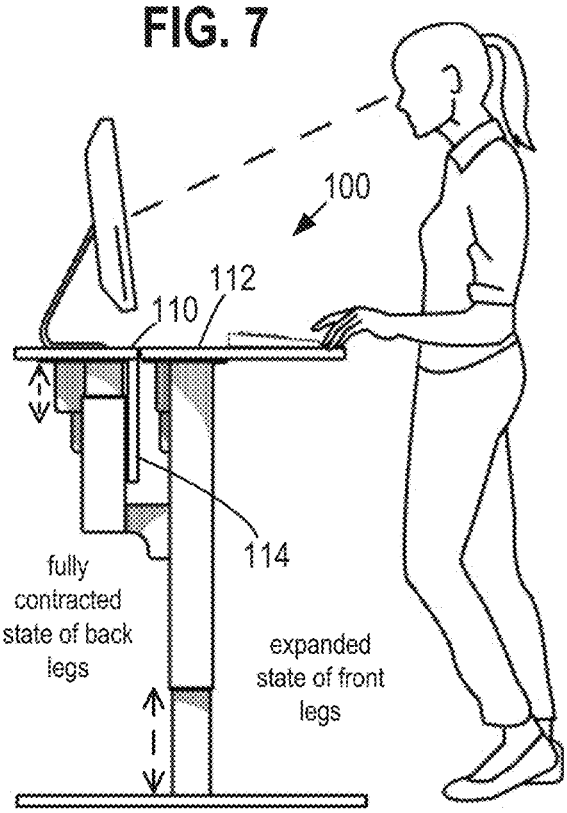
Figure 8:
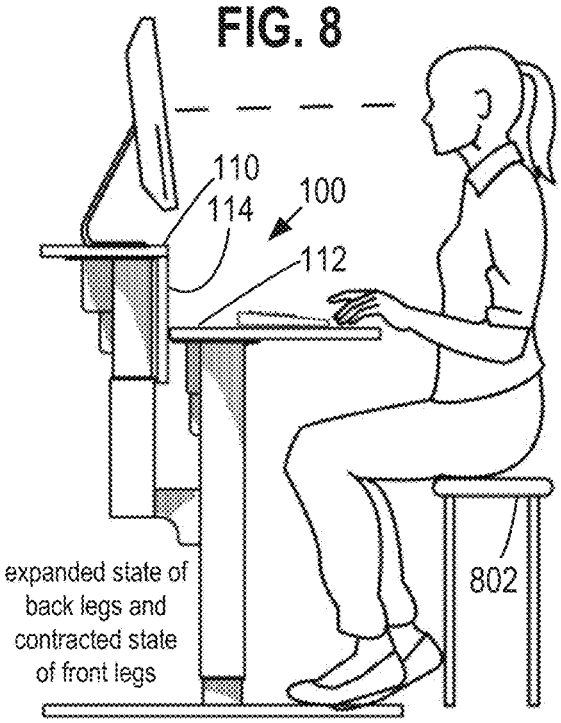
Figure 9:
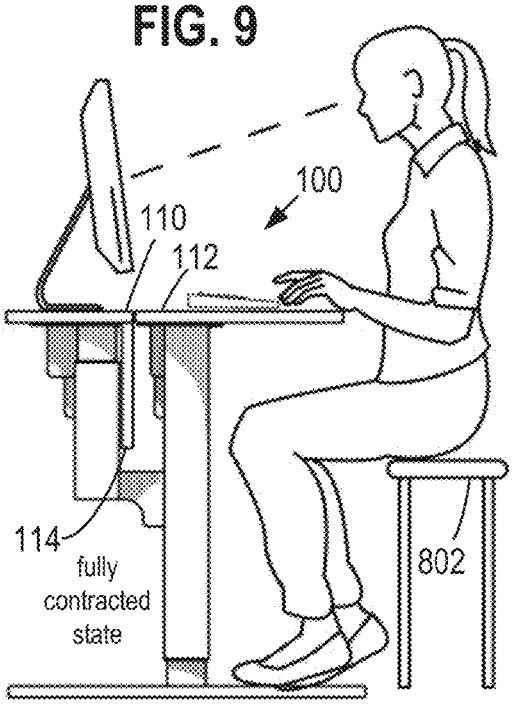

As further shown by FIGS. 6 to 9, the legs of the desk 100 have respective telescoping features in which each leg is configured to extend and contract to move the top panels upwards and downwards according to the telescoping features. For example, FIG. 6 shows the desk 100 in a fully expanded state of the desk 100 where the back legs and the front legs are expanded. In the fully expanded state, shown in FIG. 6, a user is standing and using a personal computer situated on the desk 100 such that the monitor of the computer is at eye level to the user. The eye-level accommodation to the user is provide by the back panel being at a level higher than the level of the front panel. The eye-level accommodation also occurs in the partially expanded state of the desk 100 when the back legs are expanded and the front legs are contracted, as shown in FIG. 8. Whereas, when the front legs are extended and the back legs are not, the user can stand and use the computer on the desk 100, but the monitor may not be at eye-level since the front and back top panels are flush with each other (see FIG. 8). In some circumstances, there may be benefits to the partially expanded state of the desk 100 shown in FIG. 7. The lack of the eye-level accommodation is also the case when the back and front legs are contracted fully (see FIG. 9). In a fully contracted state of the desk 100, the user is shown sitting and looking downward at the monitor. One of the benefits of the fully contracted state is that a user can sit. Also, it may be beneficial to have the two top panels of the desk 100 flush in some circumstances.

In some embodiments that do not necessarily have more than one movable top panel, an apparatus includes a frame (e.g., see frame 102), including a movable component (e.g., see movable component 104) that is configured to move upwards and downwards. The apparatus also includes a plurality of top panels (e.g., see panels 110 and 112), which include a first top panel (e.g., see back top panel 110) attached to the movable component and configured to move upwards and downwards with the movable component. The panels also include a second top panel (e.g., see top front panel 112) attached to the frame and aligned parallel to the first top panel, so that the first top panel is adjustable to be flush with the second top panel (e.g., see FIG. 2) or adjustable to a level above the second top panel (e.g., see FIG. 1). The apparatus also includes a barrier panel (e.g., see barrier panel 114) attached to the frame or the first top panel and arranged perpendicular to the first and second top panels and oriented downward from the first top panel at a side of the first top panel closest to the second top panel, so that the barrier panel provides a wall interfacing the first and second top panels when the first top panel is adjustable to a level above the second top panel.

In some of such example embodiments, wherein at least two movable top panels are included with the apparatus, the frame (e.g., see frame 102) includes a second movable component (e.g., see movable component 106) that is configured to move upwards and downwards. And, the second top panel (e.g., see top front panel 112) is attached to the second movable component and configured to move upwards and downwards with the second movable component. Also, in some embodiments, the movable component is a first movable component and the first movable component is configured to move upwards and downwards via a first telescoping mechanism including the first movable component and a first fixed part. In such examples, the first movable component and the first fixed part are components of a first leg of the frame. And, the second movable component is configured to move upwards and downwards via a telescoping mechanism including the second movable component and a second fixed part. And, the second movable component and the second fixed part are components of a second leg of the frame.

Further, in some embodiments, respective heights of the first top panel and the second top panel are adjustable independently of each other. And, in some of such examples, the respective heights of the first top panel and the second top panel are further adjustable in tandem. Also, in some embodiments, the first movable component is a part of a first leg (e.g., see back leg 105) of the frame that is oriented downward from the first top panel. In such examples, the second movable component is a part of a second leg (e.g., see front leg 107) of the frame that is oriented downward from the second top panel. And, the frame further includes an interface configured to attach the first leg of the frame to the second movable component of the frame (e.g., see bridge 108), so that the first leg moves upwards and downwards with the second movable component.

In some embodiments, the apparatus includes a desk (e.g., see desk 100) and the first top panel is at a back portion of the desk and the second top panel is at a front portion of the desk. As mentioned herein, although the great majority of examples illustrated herein include desks or more, specifically, sit-stand desks, it is to be understood that some embodiments include or are for other types of furniture or apparatuses with one or more adjustable top panels or working surfaces.

Figure 10:
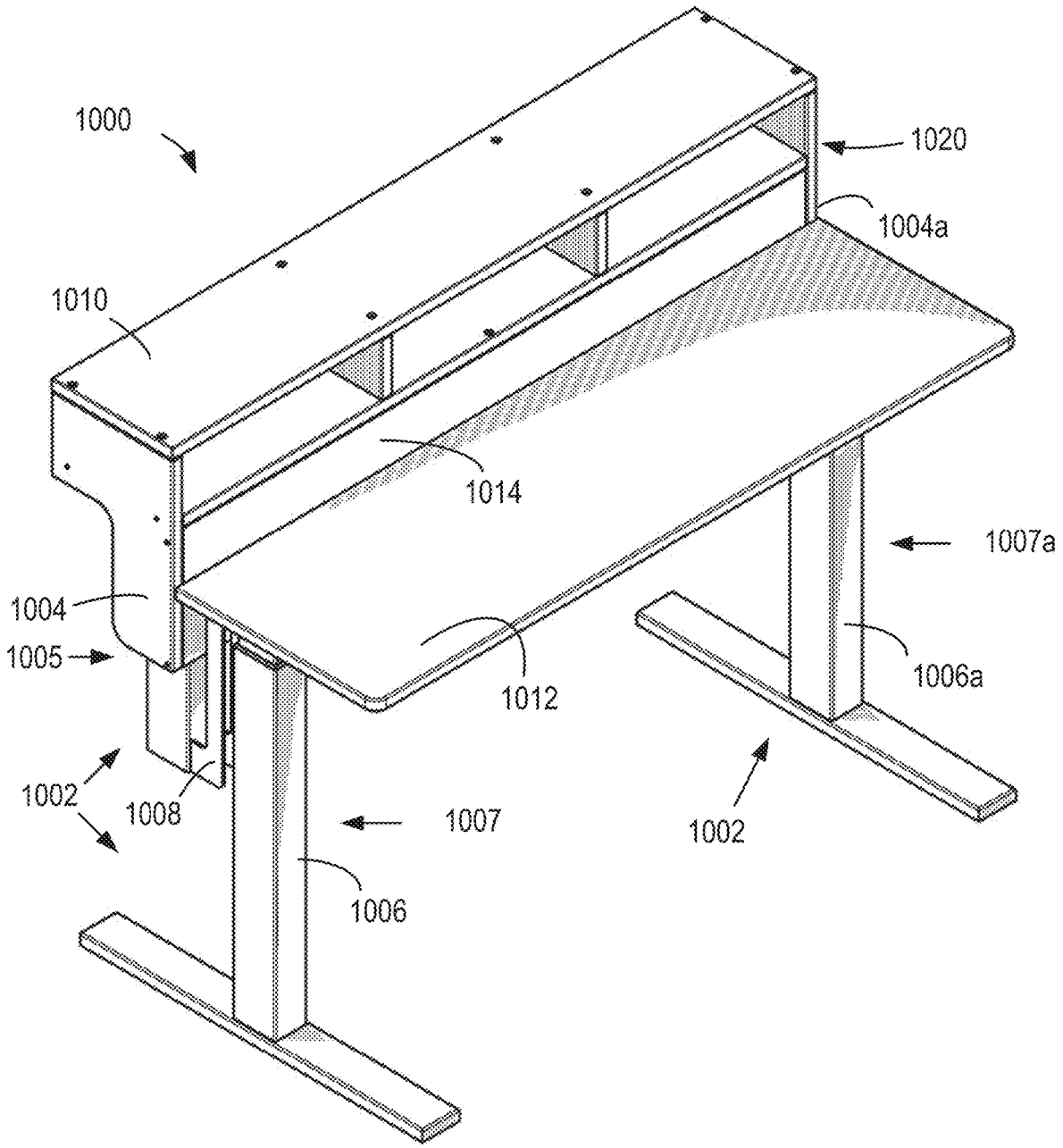
FIG. 10 illustrates a front perspective view of another desk including multiple movable panels as well as shelving, in accordance with some embodiments of the present disclosure.

In some of the desk examples, the desk includes shelving positioned above the barrier panel (e.g., see FIG. 10). In some examples with shelving, the top panels are movable to be flush with each other. In some other examples, such as the example embodiment shown in FIG. 10, the panels are movable but cannot be positioned flush with each other. This is a safety feature to prevent pinching or squeezing from the opening of the shelving accidentally closing on property or a user. Either way, in such examples and others, the shelving can move upwards and downwards with the barrier panel and the back top panel.

In some embodiments, the first movable component is configured to move upwards or downwards according to movement of at least one first actuator, and conversion of electrical energy into motion of the at least one first actuator is according to a first user input. In some of such embodiments, the second movable component is configured to move upwards or downwards according to movement of at least one second actuator, and conversion of electrical energy into motion of the at least one second actuator is according to a second user input.

In some embodiments, the first movable component is configured to move upwards or downwards according to movement of at least one first motor (e.g., see motor 300 shown in FIG. 3). And, the at least one first actuator is a part of the at least one first motor, and conversion of electrical energy into motion of the at least one first motor is according to the first user input. In some of such examples, the second movable component is configured to move upwards or downwards according to movement of at least one second motor (e.g., see motor 302). Also, the at least one second actuator is a part of the at least one second motor, and conversion of electrical energy into motion of the at least one second motor is according to the second user input.

In some embodiments, the first user input or the second user input (or any other user input described herein) is part of a computing device or a circuit that is attached to the apparatus. In some other embodiments, the first user input or the second user input (or any other user input described herein) is part of an electronics device separate from the apparatus. For example, the electronics device can include smartphone, smart watch, or personal computer.

FIG. 10 illustrates a front perspective view of another desk 1000 including multiple movable panels as well as shelving 1020. The multiple movable panels are attached to a frame 1002 that includes a movable component 1004 (which is a part of back leg 1005). The frame 1002 also includes a movable component 1006 (which is a part of front leg 1007). The frame 1002 also includes a bridge 1008 that connects the back leg 1005 and the front leg 1007. As shown, the front leg 1007 extends downward to a foot of the desk 1000. The back leg 1005 extends downward to the bridge 1008. Because of the arrangement of the legs, a foot is only used for each front leg of desk 1000. This simplifies the structure of the desk 1000 and makes it more economical to manufacture. The back leg 1005 extends from a back top panel 1010 of the desk 1000. And, the front leg 1007 extends from a top front panel 1012 of the desk 1000. The multiple panels of the desk 1000 include back top panel 1010, top front panel 1012, and barrier panel 1014 that interfaces the back and top front panels. As shown, the desk 1000 also includes respective legs opposing the front and back legs. These opposing legs include front leg 1007*a* and an opposing back leg (not shown in the figure). Thus, the desk 1000 includes four legs in which the two front legs extend downward to feet of the desk from the top front panel 1012 and the two back legs extend downward to the bridge 1008 and its opposing bridge, respectively, from the back top panel 1010. The legs also include telescoping features. Each telescoping feature of desk 1000 includes a fix part and a movable part to extend and contract the legs. In FIG. 10, the back legs are shown extended since the barrier panel 1014 is exposed and interfaces the front and back top panels. And, as shown, the front legs are in a contracted state. In the embodiment shown in FIG. 10, when the back legs are fully contracted the top front and back panels are not flush; however, the barrier panel 1014 is hidden below the top front panel and the shelving 1020 in such a state. With desk 1000, preventing the shelving 1020 from moving below the level of the top surface of the top front panel 1012 limits injuries to users and damage to property on the top front panel. Such objects could become caught, jammed, or pinched when inserted into the opening of the shelving 1020 if the safety feature did not exist with desk 1000.

Figure 11:
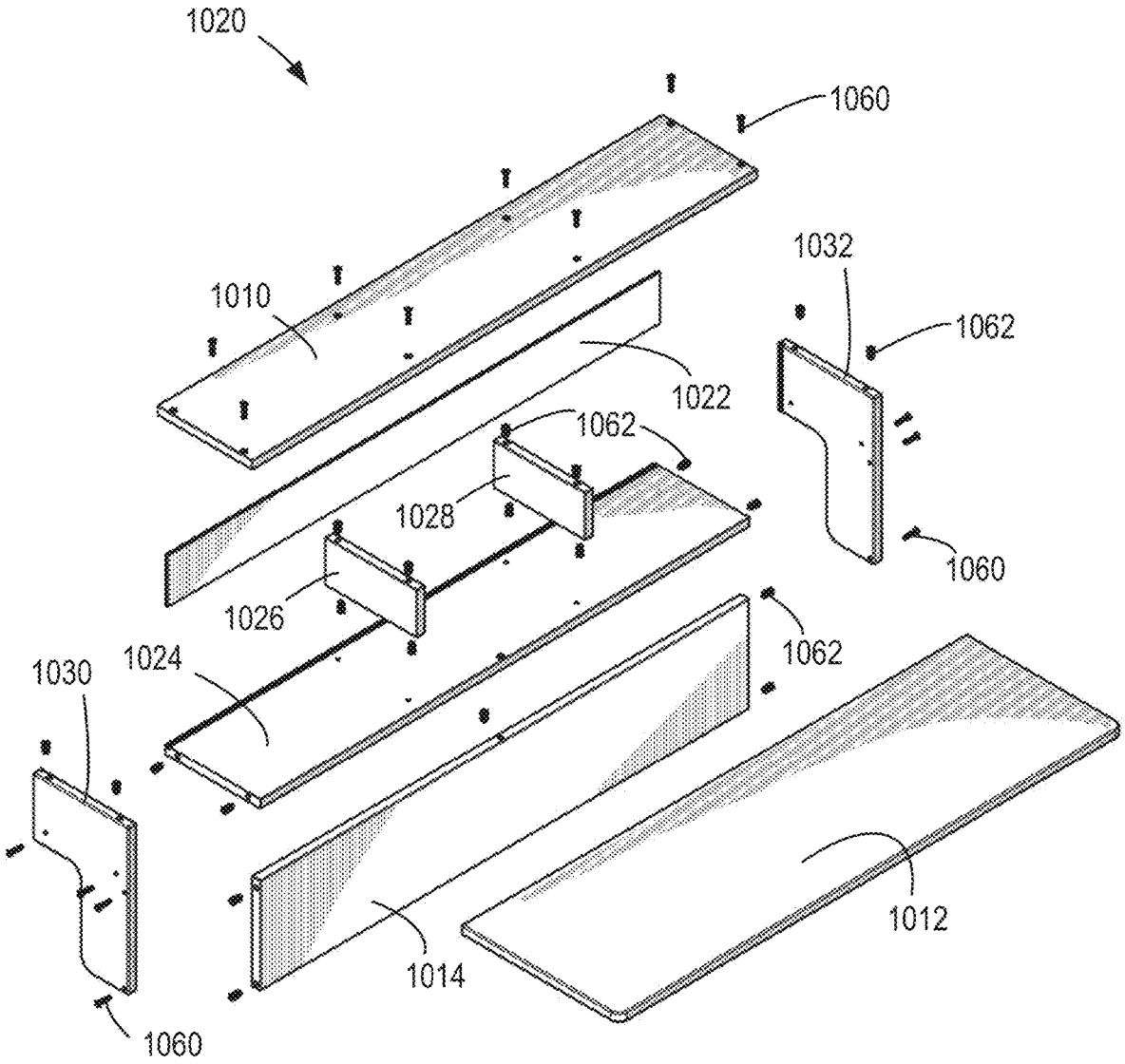
FIG. 11 illustrates a front perspective and exploded view of some example parts of the desk illustrated in FIG. 10, in accordance with some embodiments of the present disclosure.

FIG. 11 illustrates a front perspective and exploded view of some example parts of the desk illustrated in FIG. 10. Some of the parts shown make up the shelving 1020. As it appears from the exploded view the back top panel 1010 as well as back shelving panel 1022, bottom shelving panel 1024, and side panels 1030 and 1032 make up the partial encasing of the shelving 1020. Also, shown in FIG. 11, are dividers 1026 and 1028 that provide for three compartments in the shelving 1020 (e.g., also see FIG. 10). With desk 1000, the barrier panel 1014 interfaces the bottom shelving panel 1024 and the top front panel 1012 when the back legs of the desk 1000 are expanded. This is different from the desk 100, wherein the barrier panel 114 interfaces the back top panel 110 and the top front panel 112 when the back legs of the desk 100 are expanded. Also, shown are connectors for attaching the components of the desk 1000 and putting together the shelving 1020. As shown, there is a first type of connector 1060 for connections made at external areas of the shelving 1020. And, there is a second type of connector 1062 for connections made at internal areas of the shelving 1020.

Figure 12:
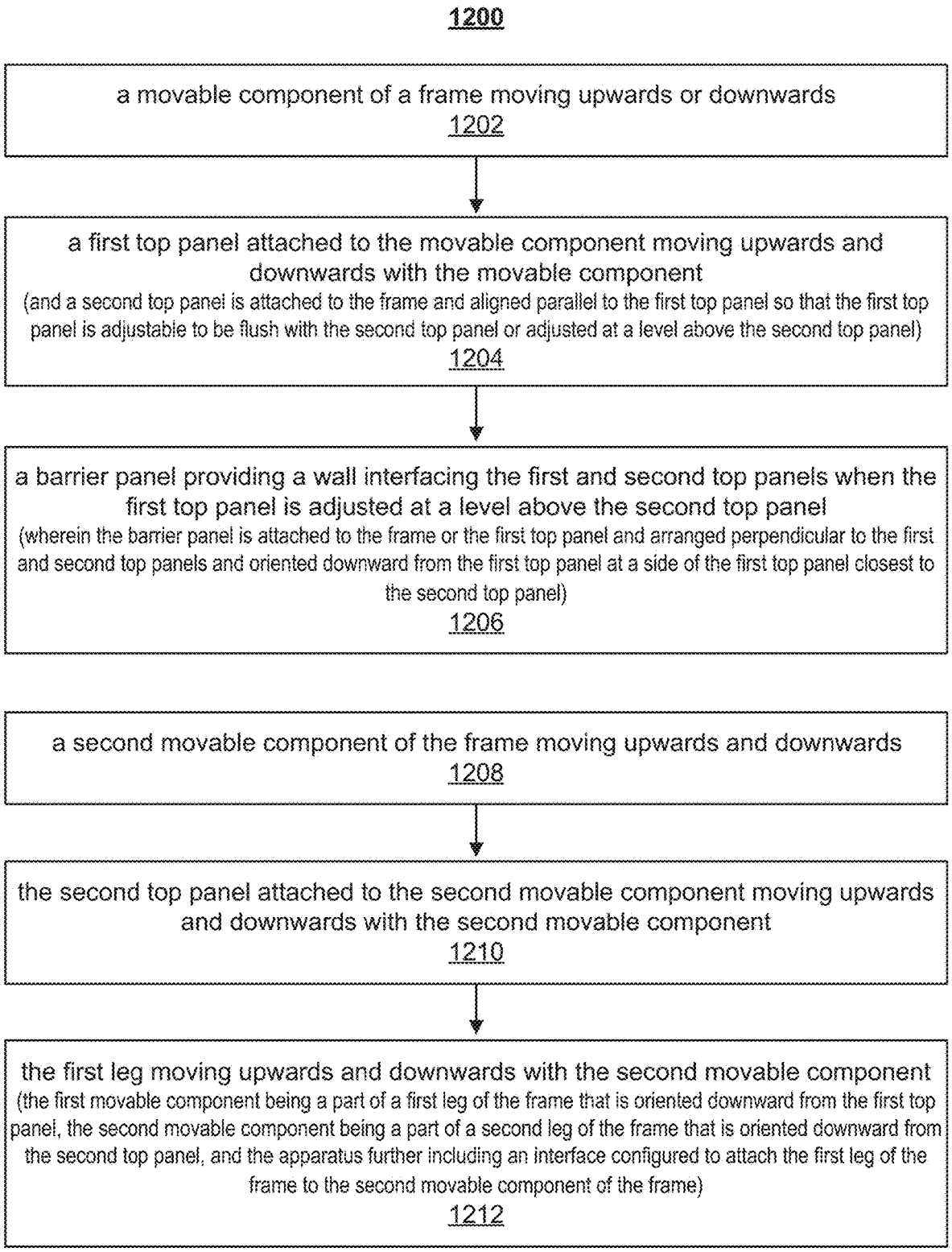
FIG. 12 depicts a method in accordance with some embodiments of the present disclosure.

FIG. 12 depicts a method 1200 that is in accordance with some embodiments of the present disclosure. The method 1200 starts with a movable component (e.g., see movable component 104) of a frame (e.g., see frame 102) moving upwards or downwards (at step 1202). The method 1200 continues with a first top panel (e.g., see back top panel 110) attached to the movable component moving upwards and downwards with the movable component (at step 1204). In such examples, a second top panel (e.g., see top front panel 112) is attached to the frame and aligned parallel to the first top panel, so that the first top panel is adjustable to be flush with the second top panel (e.g., see FIG. 2) or adjustable to a level above the second top panel (e.g., see FIG. 1). Also, the method 1200 continues with a barrier panel (e.g., see barrier panel 114) providing a wall interfacing the first and second top panels when the first top panel is adjustable to a level above the second top panel (at step 1206). The barrier panel is attached to the frame or the first top panel and arranged perpendicular to the first and second top panels and oriented downward from the first top panel at a side of the first top panel closest to the second top panel.

The method 1200 can also start or continue with a second movable component (e.g., see movable component 106) of the frame moving upwards or downwards (at step 1208). And, then the method 1200 continues with the second top panel attached to the second movable component moving upwards and downwards with the second movable component (at step 1210). In some of such examples, the movable component is a first movable component and the first movable component is a part of a first leg of the frame that is oriented downward from the first top panel. Also, in some examples, the second movable component is a part of a second leg of the frame that is oriented downward from the second top panel and the frame further includes an interface configured to attach the first leg of the frame to the second movable component of the frame. In some of such examples, the method 1200, at step 1212, further includes and continues with the first leg moving upwards and downwards with the second movable component. Also, in some examples of the method 1200, the frame is part of a desk (e.g., see desk 100) and the first top panel is at a back portion of the desk and the second top panel is at a front portion of the desk.

While the invention has been described in conjunction with the specific embodiments described herein, it is evident that many alternatives, combinations, modifications and variations are apparent to those skilled in the art. Accordingly, the example embodiments of the invention, as set forth herein are intended to be illustrative only, and not in a limiting sense. Various changes can be made without departing from the spirit and scope of the invention. For example, although the great majority of embodiments illustrated herein include desks or more, specifically, sit-stand desks, it is to be understood that some embodiments include or are for other types of furniture or apparatuses with one or more adjustable top panels or working surfaces.

What is claimed is:

1. An apparatus, comprising:

a frame, comprising a movable component that is configured to move upwards and downwards;

a plurality of top panels, comprising:

a first top panel attached to the movable component and configured to move upwards and downwards with the movable component; and a second top panel attached to the frame and aligned parallel to the first top panel, so that the first top panel is adjustable to be flush with the second top panel or adjustable to a level above the second top panel; and a barrier panel attached to the frame or the first top panel and arranged perpendicular to the first and second top panels and oriented downward from the first top panel at a side of the first top panel closest to the second top panel, so that the barrier panel provides a wall interfacing the first and second top panels when the first top panel is adjustable to a level above the second top panel, wherein the frame comprises a second movable component that is configured to move upwards and downwards, wherein the second top panel attached to the second movable component and configured to move upwards and downwards with the second movable component, wherein the movable component is a first movable component and the first movable component is configured to move upwards and downwards via a first telescoping mechanism comprising the first movable component and a first fixed part, wherein the first movable component and the first fixed part are components of a first leg of the frame that is oriented downward from the first top panel, wherein the second movable component is configured to move upwards and downwards via a telescoping mechanism comprising the second movable component and a second fixed part, wherein the second movable component and the second fixed part are components of a second leg of the frame that is oriented downward from the second top panel, and wherein the frame further comprises an interface that attaches the first leg of the frame to the second movable component of the frame, so that the first leg moves upwards and downwards with the second movable component.

2. The apparatus of claim 1, wherein respective heights of the first top panel and the second top panel are adjustable independently of each other.

3. The apparatus of claim 2, wherein the respective heights of the first top panel and the second top panel are further adjustable in tandem.

4. The apparatus of claim 1, wherein the apparatus comprises a desk and wherein the first top panel is at a back portion of the desk and the second top panel is at a front portion of the desk.

5. The apparatus of claim 4, wherein the desk comprises shelving positioned above the barrier panel.

6. The apparatus of claim 5, wherein the shelving moves upwards and downwards with the barrier panel and the first top panel.

7. The apparatus of claim 1, wherein the first movable component is configured to move upwards or downwards according to movement of at least one first actuator, and wherein conversion of electrical energy into motion of the at least one first actuator is according to a first user input.

8. The apparatus of claim 7, wherein the second movable component is configured to move upwards or downwards according to movement of at least one second actuator, and wherein conversion of electrical energy into motion of the at least one second actuator is according to a second user input.

9. The apparatus of claim 8, wherein the first movable component is configured to move upwards or downwards according to movement of at least one first motor, wherein the at least one first actuator is a part of the at least one first motor, and wherein conversion of electrical energy into motion of the at least one first motor is according to the first user input.

10. The apparatus of claim 9, wherein the second movable component is configured to move upwards or downwards according to movement of at least one second motor, wherein the at least one second actuator is a part of the at least one second motor, and wherein conversion of electrical energy into motion of the at least one second motor is according to the second user input.

11. A method, comprising:

a movable component of a frame moving upwards or downwards;

a first top panel attached to the movable component moving upwards and downwards with the movable component, wherein a second top panel attached to the frame and aligned parallel to the first top panel, so that the first top panel is adjustable to be flush with the second top panel or adjustable to a level above the second top panel;

a barrier panel providing a wall interfacing the first and second top panels when the first top panel is adjustable to a level above the second top panel, wherein the barrier panel is attached to the frame or the first top panel and arranged perpendicular to the first and second top panels and oriented downward from the first top panel at a side of the first top panel closest to the second top panel;

a second movable component of the frame moving upwards or downwards; and the second top panel attached to the second movable component moving upwards and downwards with the second movable component, wherein the movable component is a first movable component and the first movable component is a part of a first leg of the frame that is oriented downward from the first top panel, wherein the second movable component is a part of a second leg of the frame that is oriented downward from the second top panel, wherein the frame further comprises an interface that attaches the first leg of the frame to the second movable component of the frame, and wherein the method further comprises the first leg moving upwards and downwards with the second movable component.

12. The method of claim 11, wherein the frame is a part of a desk and wherein the first top panel is at a back portion of the desk and the second top panel is at a front portion of the desk.

13. A desk, comprising:

a frame, comprising a movable component that is configured to move upwards and downwards;

a plurality of top panels, comprising:

a back top panel attached to the movable component and configured to move upwards and downwards with the movable component; and a front top panel attached to the frame and aligned parallel to the back top panel, so that the back top panel is adjustable to be flush with the front top panel or adjustable to a level above the front top panel; and a barrier panel attached to the frame or the back top panel and arranged perpendicular to the back and front top panels and oriented downward from the back top panel at a side of the back top panel closest to the front top panel, so that the barrier panel provides a wall interfacing the back and front top panels when the back top panel is adjustable to a level above the front top panel, wherein the frame comprises a front movable component that is configured to move upwards and downwards, wherein the front top panel attached to the front movable component and configured to move upwards and downwards with the front movable component, wherein the movable component is a back movable component that is a part of a back leg of the frame that is oriented downward from the back top panel, wherein the front movable component is a part of a front leg of the frame that is oriented downward from the front top panel, and wherein the desk further comprises an interface that attaches the back leg of the frame to the front movable component of the frame, so that the back leg moves upwards and downwards with the front movable component.

14. The desk of claim 13, wherein respective heights of the back top panel and the front top panel are adjustable independently of each other.

15. The desk of claim 14, wherein the respective heights of the back top panel and the front top panel are further adjustable in tandem.

16. The desk of claim 13, wherein the back top panel is at a back portion of the desk and the front top panel is at a front portion of the desk.

17. The desk of claim 16, wherein the desk comprises shelving positioned above the barrier panel.

18. The desk of claim 17, wherein the shelving moves upwards and downwards with the barrier panel and the back top panel.

19. The desk of claim 13, wherein the back movable component is configured to move upwards or downwards according to movement of at least one first actuator, and wherein conversion of electrical energy into motion of the at least one first actuator is according to a first user input.

20. The desk of claim 19, wherein the front movable component is configured to move upwards or downwards according to movement of at least one second actuator, and wherein conversion of electrical energy into motion of the at least one second actuator is according to a second user input.

* * * * *